US005121813A

United States Patent [19]

Funston

[11] Patent Number: 5,121,813

[45] Date of Patent: Jun. 16, 1992

[54] LADDER ACCESSORIES

[75] Inventor: Robert L. Funston, Victoria, Australia

[73] Assignee: Altrone Innovations PTY. LTD., Australia

[21] Appl. No.: 602,307

[22] PCT Filed: May 26, 1989

[86] PCT No.: PCT/AU89/00233

§ 371 Date: Jan. 28, 1991

§ 102(e) Date: Jan. 28, 1991

[87] PCT Pub. No.: WO89/11579

PCT Pub. Date: Nov. 30, 1989

[30] Foreign Application Priority Data

May 27, 1988 [AU] Australia ..... PI8486/88
May 27, 1988 [AU] Australia ..... PI8487/88
Sep. 26, 1988 [AU] Australia ..... PJ0627/88

[51] Int. Cl.[5] ..... E06C 7/44; E06C 7/48

[52] U.S. Cl. ..... 182/203; 182/107; 182/206

[58] Field of Search ..... 182/203, 204, 205, 201, 182/107, 108, 206

[56] References Cited

U.S. PATENT DOCUMENTS 310,218 1/1885 Norton ..... 182/204
1,609,257 11/1926 Lazear .
1,705,000 3/1929 Brandt ..... 182/204
2,245,306 6/1941 Smith ..... 182/203
2,306,797 12/1942 Biery .
4,249,638 2/1981 Fernandez ..... 182/204
4,984,655 1/1991 Scherer ..... 182/204

FOREIGN PATENT DOCUMENTS 680797 9/1939 Fed. Rep. of Germany ..... 182/206
3534693 4/1987 Fed. Rep. of Germany .
0396892 4/1909 France .

*Primary Examiner*—Reinaldo P. Machado
*Attorney, Agent, or Firm*—Sughrue, Mion, Zinn, Macpeak & Seas

[57] ABSTRACT

A stabilizing leg for attachment to a ladder for use on uneven surfaces comprises a rigid leg member (3) having a central longitudinal slot (6) through which extend U-bolts (17) for clamping the leg member (3) to the rungs (15) of the ladder. The U-bolts can be slackened to permit the leg member (3) to slide vertically relative to the rungs between stored and extended positions, and also to slide along the rungs between the opposed stiles. The leg can be used on a ladder without specific adaptation of the ladder. There is also disclosed a hooking support (30) for attachment to the stiles at the upper end of the ladder for supporting the ladder from a ledge or spouting. The support comprises a number of adjacent hooking portions (34*a*) to (34*d*) spaced by a fraction of the ladder rung spacing.

6 Claims, 3 Drawing Sheets

LADDER ACCESSORIES

The present invention relates to accessories for ladders. and more particularly accessories suitable for use with extension-type ladders.

The dangers of using ladders on uneven ground have long been recognized. A second problem arising when using ladders occurs when the ladder slips against the wall or surface upon which it rests. The present invention seeks to solve these safety problems.

According to one aspect of the present invention, there is provided a stabilizing leg for attachment to the rungs of a ladder, comprising a rigid leg member, and clamping means for clamping the leg member to a plurality of rungs of the ladder such that the leg member projects transversely to the rungs, the leg member being slidable longitudinally relative to said clamping means and being securable in a selected position by tightening the clamping means.

According to another aspect of the present invention, there is provided a support for attachment to the stile of ladder, said support, in use, extending along the uppermost end of the ladder stile and comprising a plurality of longitudinally-spaced hooking portions, respective hooking portions being joined by rectilinear sections which are upright at normal ladder inclinations.

Embodiments of the invention will now be described, by way of example only, with reference to the accompanying drawings, in which.

Figure 1:
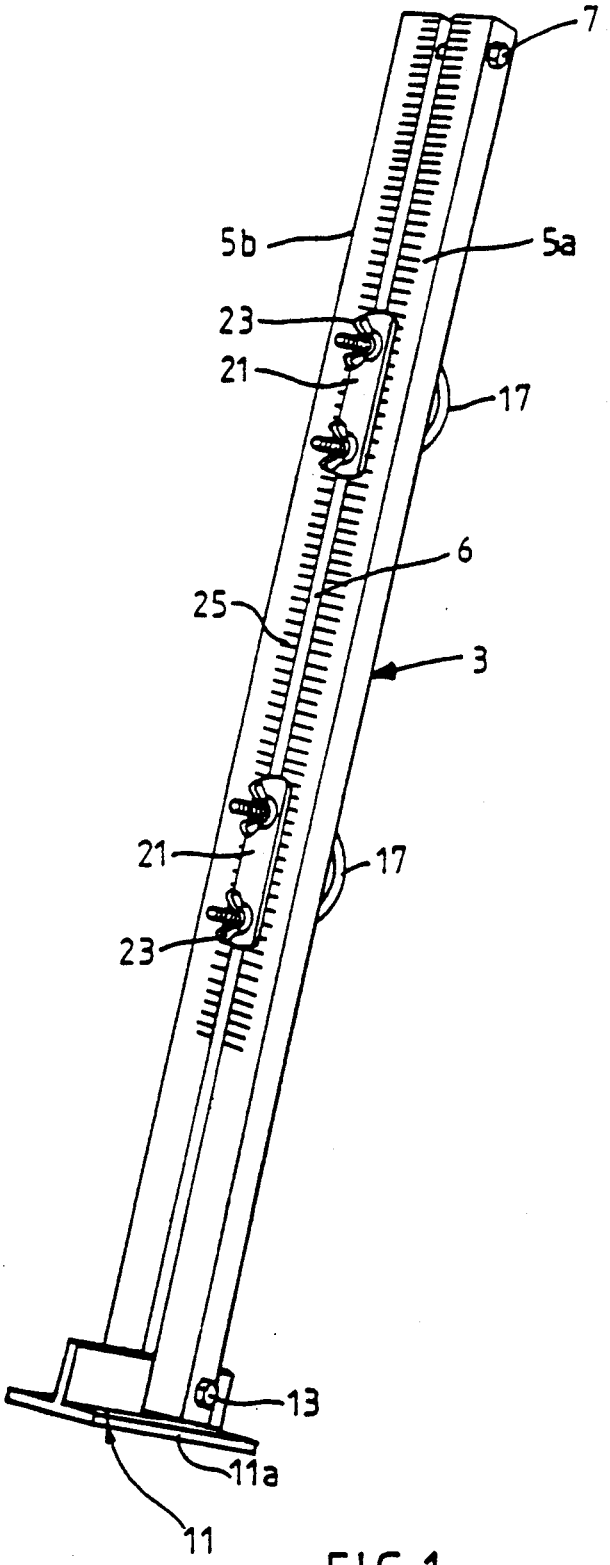
FIG. 1 is a rear perspective view of a stabilizing leg in accordance with the invention.
Figure 3:
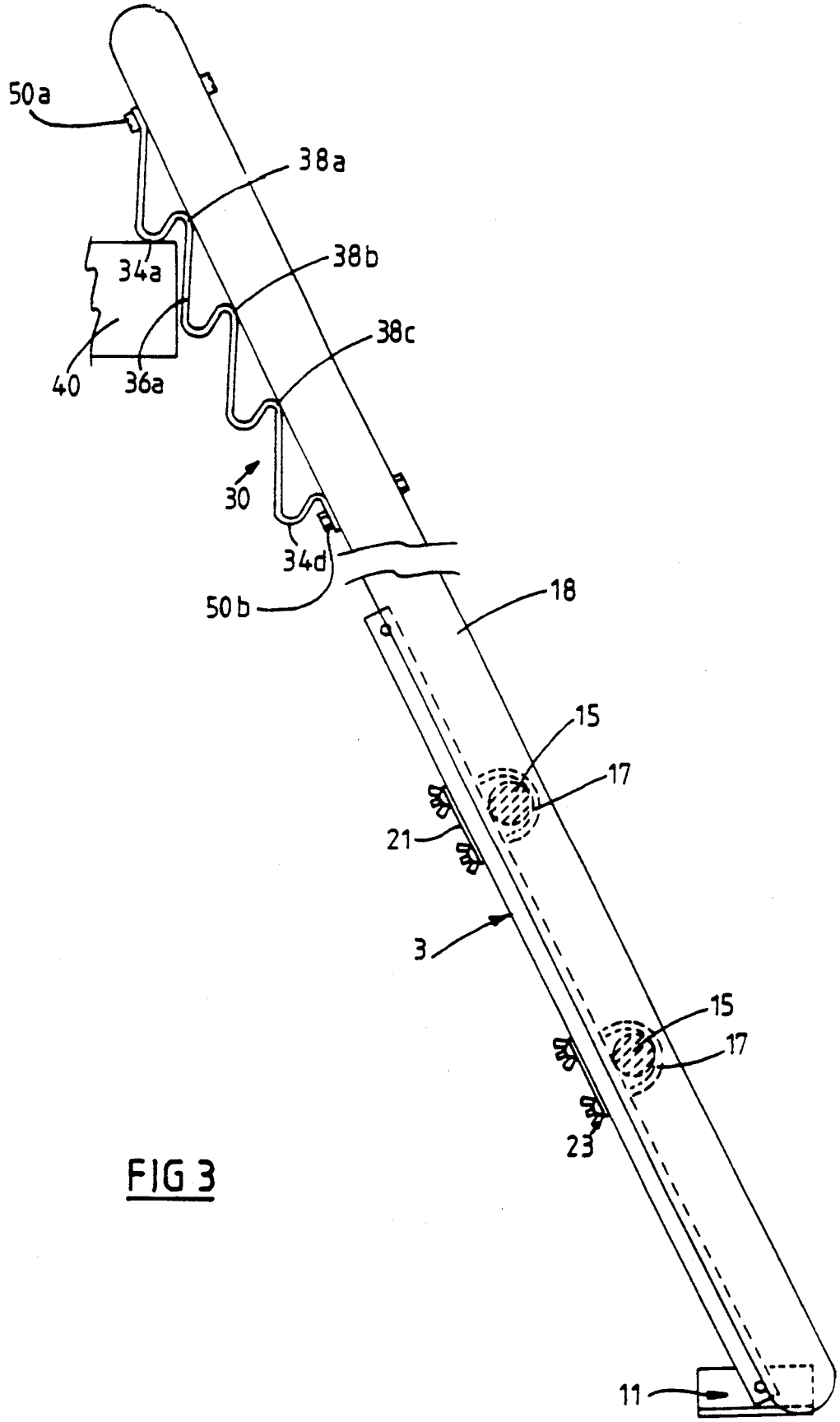
FIG. 3 is a fragmentary side view of a ladder, showing the stabilizing leg and support when attached to the ladder.

The stabilizing leg shown in FIGS. 1 and 3 comprises a rigid leg member 3 consisting of two lengths of square tubing 5*a*, 5*b* lying parallel one to the other and spaced to define a parallel-sided slot 6 extending the length of the leg member 3. The lengths of square tubing 5*a*, 5*b* are fastened together adjacent their uppermost ends by a bolt 7, the lengths 5*a*, 5*b* being separated by a spacer mounted on the shank of the bolt 7 to provide the slot 6. A T-section foot piece 11 is centrally mounted between the lengths 5*a*, 5*b* at their lower ends by a bolt 13 which extends between the lengths 5*a*, 5*b*. Spacers (not shown) mounted on the bolt 13 at either side of the T-section foot piece 11 maintain the foot piece 11 in a central position between the lengths 5*a*, 5*b*, while permitting pivotal movement of the foot piece 11 about the shank of the bolt 13. The foot piece 11 is cut from a length of T-sectioned stock so that the base 11*a* of the foot piece is in the form of a plane plate. The pivotal mounting of the foot piece 11 allows the plate 11*a* to sit firmly on the ground at varying ladder inclinations.

As shown in FIG. 3, the rigid leg member 3 is clamped to the lower rungs 15 of a ladder by a plurality of U-bolts 17 mounted in the slot 6, the leg member 3 being located behind the rungs 15 and parallel to the stiles 18. The U-bolts 17 are inserted through the slot 6 from the front of the ladder so that the curved head portion of each U-bolt embraces a different one of the ladder rungs and the threaded sections of the bolt extend to the rear through the slot 6. The threaded ends of the U-bolt 17 project rearwardly to receive a fastening plate 21 to be secured by wing nuts 23. The wing nuts

23, when secured, clamp the rigid leg member 3 against the rear of the rungs and the curved head portions of the U-bolts against the front of the rungs thereby preventing movement of the stabilizing leg relative to the ladder. Preferably, the rear surface of each length 5*a*, 5*b* on each side of the slot 6 is serrated as shown at 25, with the inner surface of the plate 21 being similarly serrated, so that the plate 21 and thus the U-bolt 17 can be positively clamped against the leg member 3 in order to prevent any risk of accidental slippage. By loosening the wing nuts 23, sufficiently to free the plate 21 from the surface of the leg member 3, the leg member 3 can be slid longitudinally relative to the rungs between an inoperative, retracted, position in which the foot piece 11 is above the lower ends of the stiles and a lowered, extended, position in which the foot piece 11 acts to stabilize the ladder when the ladder is used on uneven ground, the leg member 3 being slid laterally along the rungs to lie adjacent one or other of the stiles in its operative position. In its inoperative position, the leg member 3 can be located centrally between the stiles so as not to interfere with operation of an extension ladder; also the leg member 3 being located behind the main ladder, does not impede access to the ladder. The stabilizing leg can thus remain permanently attached to the ladder, to be used as required.

The stabilizing leg can easily be mounted onto the ladder without any modifications being made to the ladder. The stabilizing leg is made from standard components and thus can be manufactured inexpensively. The U-bolts are able to slide individually along the central slot 6 of the leg member thus enabling the spacing between the U-bolts along the leg to be varied so that the same stabilizing leg can be used with most ladders currently available.

Figure 2:
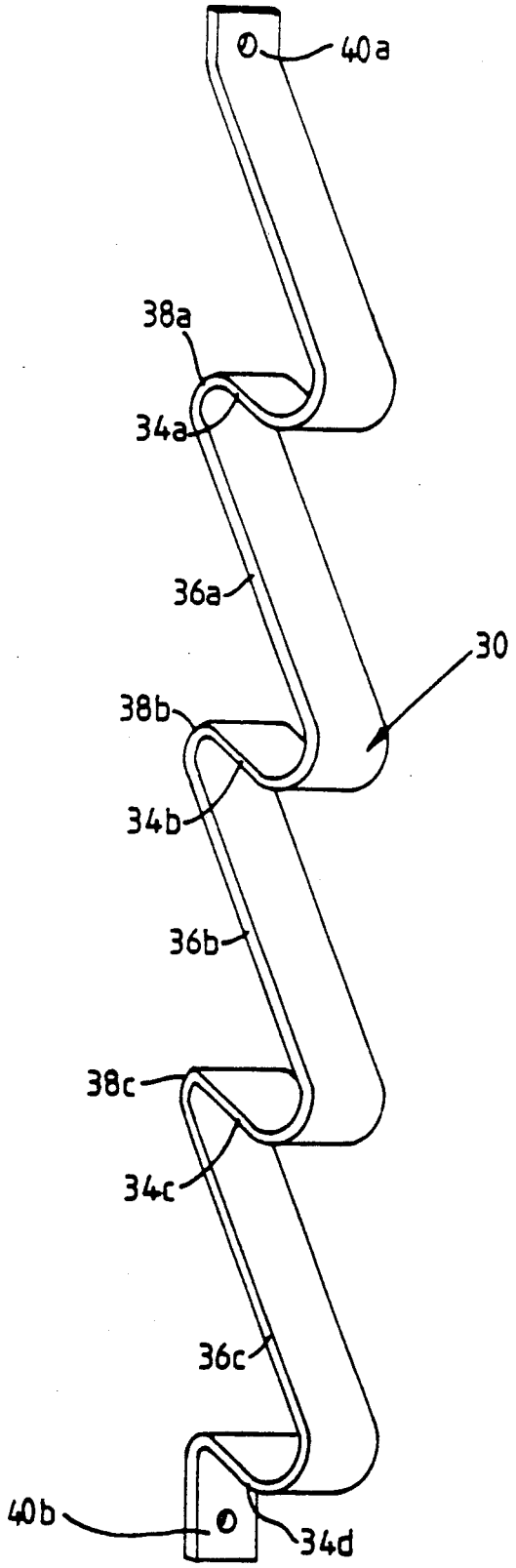
FIG. 2 is a rear perspective view of a support in accordance with the invention.

FIGS. 2 and 3 show a support 30 which is fabricated from metal strip and is attached to the uppermost end of the stile of a ladder. Usually, the support is mounted on an extension ladder, with the ladder carrying two such supports, one on each of its stiles. The support 30 comprises a plurality of longitudinally-spaced hooking portions 34*a* to 34*d*, with respective hooking portions being joined by rectilinear sections 36*a*, 36*b*, 36*c*. The spacing between the adjacent hooking portions 34*a* to 34*d* is only a fraction (typically 1/5) of the rung spacing to versility of operation, as will be described subsequently. The rectilinear sections 36*a* to 36*c* are substantially vertical when the ladder is at normal inclinations. The support 30 when viewed from the side has the profile of a rounded-end saw tooth. The low points of this profile 38*a* to 38*c* rest against the ladder stiles when the support is secured to the ladder. The support 30 is secured to the uppermost end of the stile of the ladder by bolts 50*a*, 50*b* which pass through respective end portions 40*a*, 40*b* of the support. The portions 40*a*, 40*b* are of a flat form so as to bear against the ladder stile.

In use the support 30 can engage a ledge 40 and will prevent the ladder from falling backwards or sideways in most situations, the forces acting between the support and the ledge to resist movement of the ladder increasing with increasing load on the ladder. On spouting one of the hooking portions will hook over the edge of the spouting and the adjacent lower rectilinear section will lie substantially flat against the spouting wall. This prevents damage to the spouting as the load bearing area is greatly increased.

The incorporation of the several hooking portions in the support spaced by only a fraction of the rung spacing enables the ladder to be extended and placed so that one of the hooking sections will engage a ledge or spouting without having to vary the inclination of the ladder to any great extent.

The support described can be simply fabricated from aluminium strip.

The embodiments have been described by way of example and modifications are possible within the scope of the invention.

I claim:

1. A stabilizing leg for attachment to the rungs of a ladder for stabilizing the ladder on uneven ground, comprising a rigid leg member and clamping means for clamping the leg member to a plurality of rungs of the ladder such that the leg member projects transversely to the rungs, the leg member being slidable transversely between opposed operative positions adjacent the respective stiles of the ladder and the leg member being slidable longitudinally relative to said clamping means to provide an extended support in a position adjacent a selected one of the stiles, the leg member being securable in its extended support position by tightening the clamping means, wherein the leg member comprises a longitudinal slot which extends between opposite sides of the leg member and the clamping means comprises a plurality of separate clamps each slidable longitudinally of the member, each said clamp comprising a U-bolt located within the slot to provide a head portion which projects from one side of the leg member whereby the head portion is operative to engage a respective rung and clamp the rung against the adjacent side of the leg member, and threaded tail portions of the U-bolt extend on the opposite side of the leg member and carry clamping nuts.

2. A stabilizing leg according to claim 1, wherein each clamp further comprises a clamping plate interposed between the nuts and the adjacent side of the leg member, the plate and the adjacent side of the leg member being serrated to provide positive locking of the plate relative to the leg member.

3. A stabilizing leg according to claim 1, wherein the leg member comprises parallel lengths of rigid elongate material rigidly connected with a space between the lengths to define the longitudinal slot.

4. A stabilizing leg according to claim 2, further comprising a foot member pivotally mounted at the lower end of the leg member.

5. A ladder comprising rungs and stiles, a stabilizing leg according to claim 1 mounted on the rungs at the lower end of the ladder, and a support attached at the upper end of the ladder to one of said stiles, said support comprising a plurality of longitudinally spaced hooking portions, respective hooking portions being joined by rectilinear sections which are upright at normal ladder inclinations.

6. A ladder according to claim 5, wherein the adjacent hooking portions of the support are spaced longitudinally by a distance substantially less than the spacing between adjacent rungs of the ladder.

* * * * *